US006149282A

United States Patent [19]

Huang

[11] Patent Number: 6,149,282

[45] Date of Patent: Nov. 21, 2000

[54] ATTACHABLE CHRISTMAS LIGHT

[76] Inventor: Shun-Feng Huang, 56, Min Sheng Street, Feng-Yuan City, Taichung 42041, Taiwan

[21] Appl. No.: 09/075,240

[22] Filed: May 4, 1998

[51] Int. Cl.[7] ..... H01R 33/00; H01R 13/60; F21V 21/00

[52] U.S. Cl. ..... 362/226; 362/249; 362/391; 362/396; 439/574; 439/619

[58] Field of Search ..... 362/226, 123, 362/249, 391, 396; 439/356, 574, 602, 619, 699.2

[56] References Cited

U.S. PATENT DOCUMENTS

| | | | |
|---|---|---|---|
| 4,777,573 | 10/1988 | Liao | 362/249 |
| 5,779,352 | 7/1998 | Lin | 362/249 |
| 5,791,765 | 8/1998 | Lin | 362/250 |

*Primary Examiner*—Cassandra Spyrou
*Assistant Examiner*—Jennifer Winstedt

[57] ABSTRACT

An attachable Christmas light is provided. The light includes a receptacle of tubular body, having an upper opening, a pair contact plate in the bottom respestively conneoted to a pair of electrical wires, and a pair of positioning arms laterally extended from an outer periphery abutting the opening and each including a retaining hole abutting a vertical slot at front end, and a lamp including a bulb embedded itno a base which is engageable itno the receptacle with a pair of contact wire engaged with the contact plates and a pair of binding rods paralled extended laterally from an upper periphery and positioned in alignment with the positioning arms, when a linear object is disposed in place between the binding rods and the positioning arms, the binding rods are bent downward about 90° to have front ends retained into the retaining holes of the positioning arms. So that the light is stably attached to the linear object.

1 Claim, 9 Drawing Sheets

ATTACHABLE CHRISTMAS LIGHT

BACKGROUND OF THE INVENTION

The present invention relates to lights and more particularly to an attachable Christmas lights which is attachable to net and trellis objects or a christmas tree in an outdoor party.

Typical Christmas lights are arranged in series on attachable objects such as net, trellis or christmas tree. However, there is no binding means to tie the lights to the object. It is always a wearisome job to attach the Christmas lights snugly.

The present invention obviates the above discussed disadvantage and provides an attachable christmas light.

SUMMARY OF THE PRESENT INVENTION

The present invention has a main object to provide an attachable Christmas light which includes a suitable binding device to snugly and readily tie the lights onto the net and trellis object or the christmas tree.

Another object of the present invention is to provide an attachable christmas light which enables one to regulate the electrical wires neatly without tanglement or disorder.

Still another object of the present invention is to provide an attachable christmas light in which the binding device makes the lamp more stable within the receptade to prevent the lamp from disengagement with the receptacle.

Accordingly, the attachable christmas light of the present invention comprises generally a lamp including a base and a receptacle. The base has a pair of binding rods made from flexible material parallel extending from a lateral peripheral wall and that function in cooperation with a pair of positioning arms which are parallel extending from a lateral peripheral wall. When a linear object is in place between the binding rods and the positioning arms, the flexible binding rods are bent downward until their front ends are engaged into the retaining holes of the positioning arms so as to tightly fasten the light onto the linear object. To untie the light is to disengage the binding rods from the positioning arms so as to easily removed the light up from the linear object. Since the flexible binding rods can be used repeatedly, the Christmas light of the present invention is more durable than conventional christmas lights.

The present invention will become more fully understood by reference to the following detailed description thereof when read in conjunction with the attached drawings.

DETAILED DESCRIPTION OF THE PREFERRED EMBODIMENT

Figure 1:
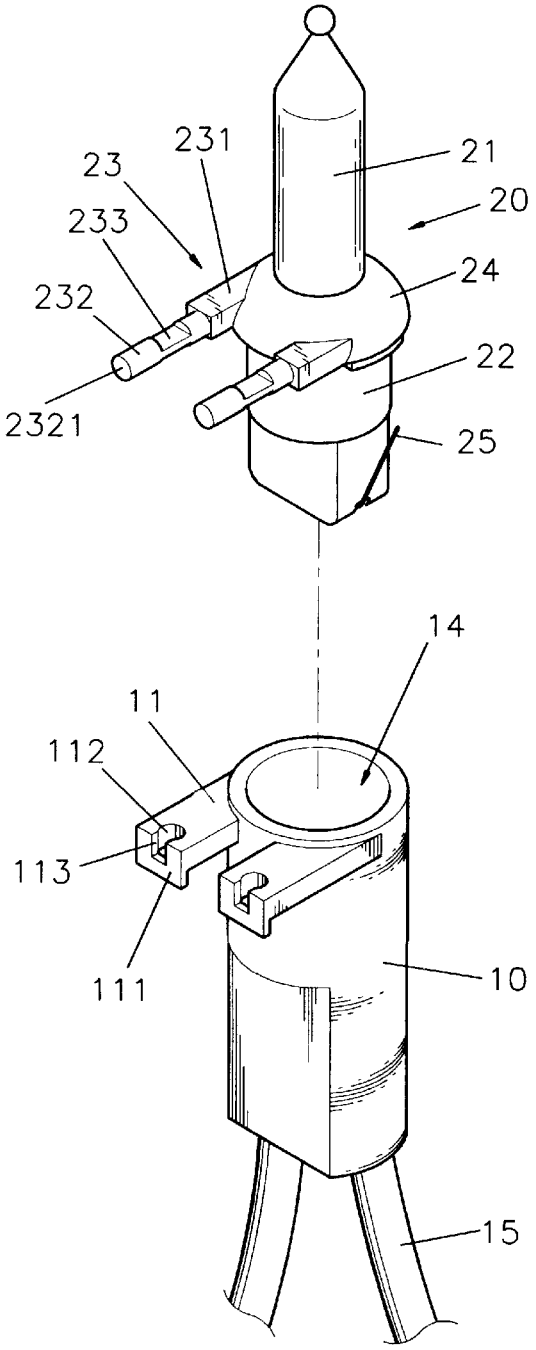
FIG. 1 is an exploded perspective view showing a preferred embodiment according to present invention.

With reference to FIGS. 1 to 4 of the drawings, the attchable christmas light of the present invention comprises generally a receptacle 10 and a lamp 20, the receplacle 10 includes a tubular body, an upper opening 14, a pair of contact plates in the bottom (not shown) to respectively connect with a pair of electrical wires 15, and a pair of positioning arms 11 of roughly L-shaped section each including a vertical retaining hole 112 and a slot 113 in a downward portion 111 of the arm 11 abutting the hole 112.

The lamp 20 includes a bulb 21 embedded into a base 22 with a pair of contact wires 25 exposed to outside of the bottom of the base 22 which is frictionally secured into the opening 14 of the receptacle 10 with the contact wires 25 respectively engaged with the corresponding contact plates inside the receptacle 10, a pair of binding rods 23 integrated with a large diameter sloped flange 24 on the top of the base 20 and parallel extended outward from a lateral periphery of the flange each having a rigid portion 231 and a flexible portion 232 and a flat portion 233 at a middle of the flexible portion 232 for facilitating the bending of the rods 23 up and down relative to its longitndinal axis.

Figure 2:
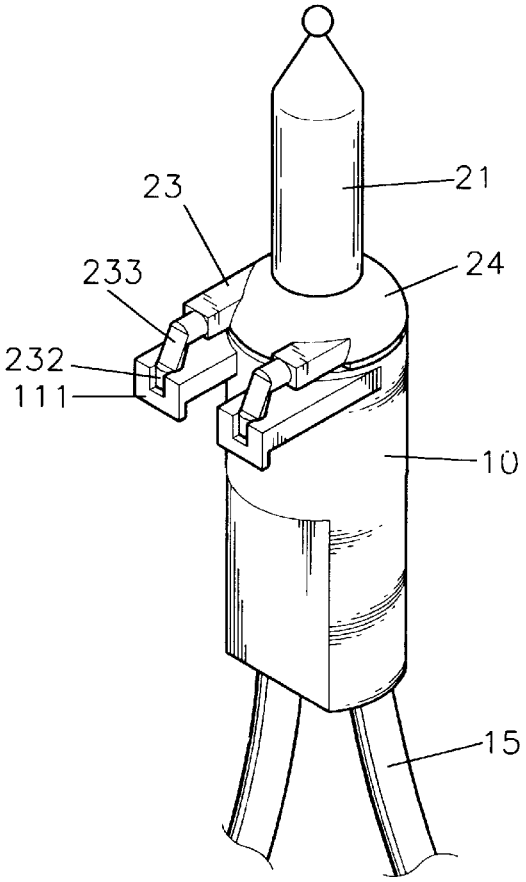
FIG. 2 is a persective view of the assembled light of FIG. 1 where the binding rods are engaged into the retaining holes of the positioning arms.
Figure 3:
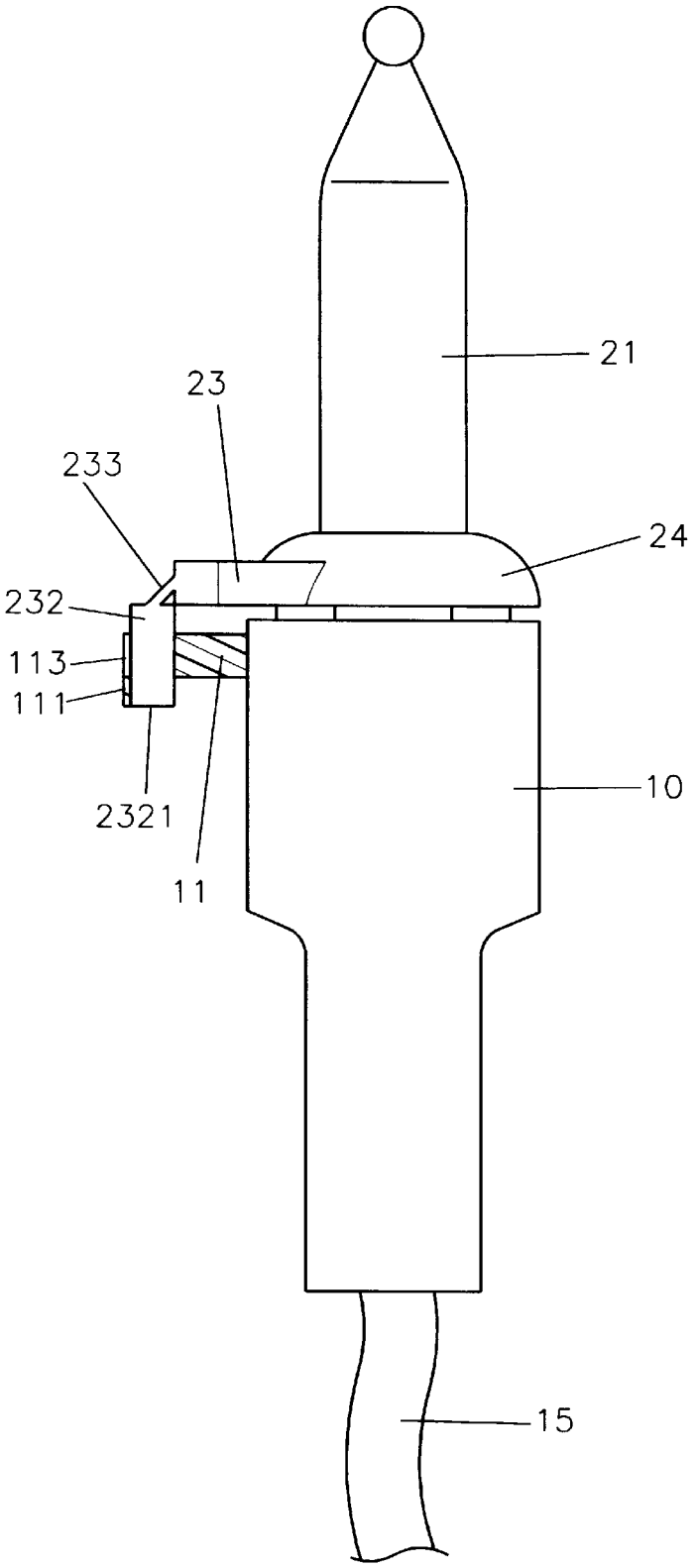
FIG. 3 is a side elevational side of FIG. 2 to illustrate that the binding rods are bent downward for about 90 relative to its longitudinal axis and completely engaged into the retaining holes.
Figure 4:
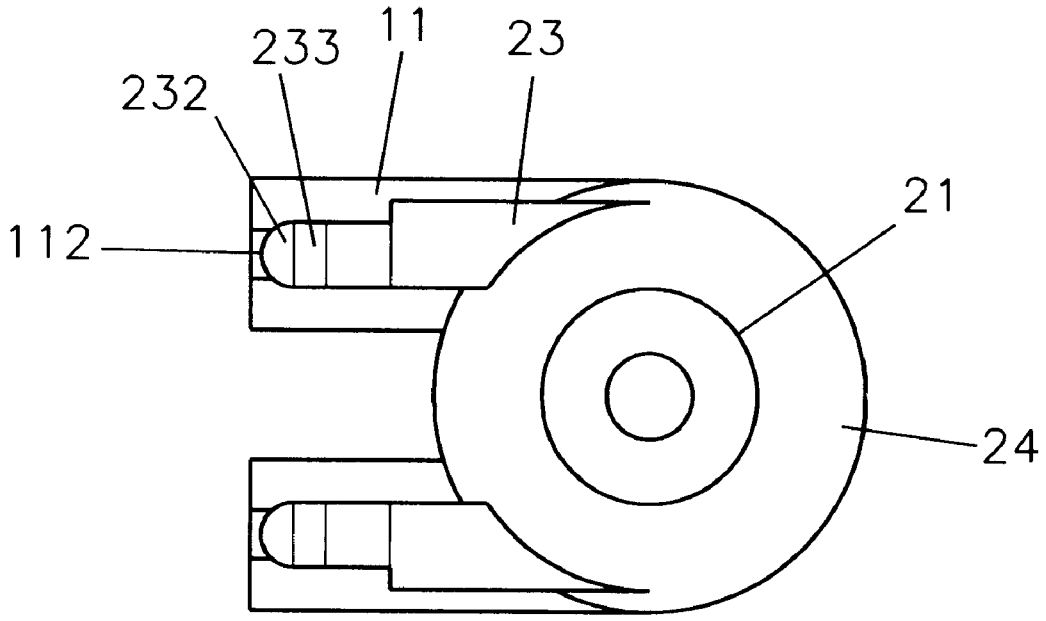
FIG. 4 is a top view of FIG. 2.

When the lamp 20 is disposed into the receptacle the binding rods 23 should be in alignment with the positioning arms 11 so as to enable the binding rods 23 to be bent down about 90° relative to its longitndinal axis and its front ends 232 to be temporarily retained in the retaining holes 112 (as shown in FIGS. 2 to 4). This arrangement provides the advantage that the lamp 20 would be stable within the receptacle 10.

Figure 5:
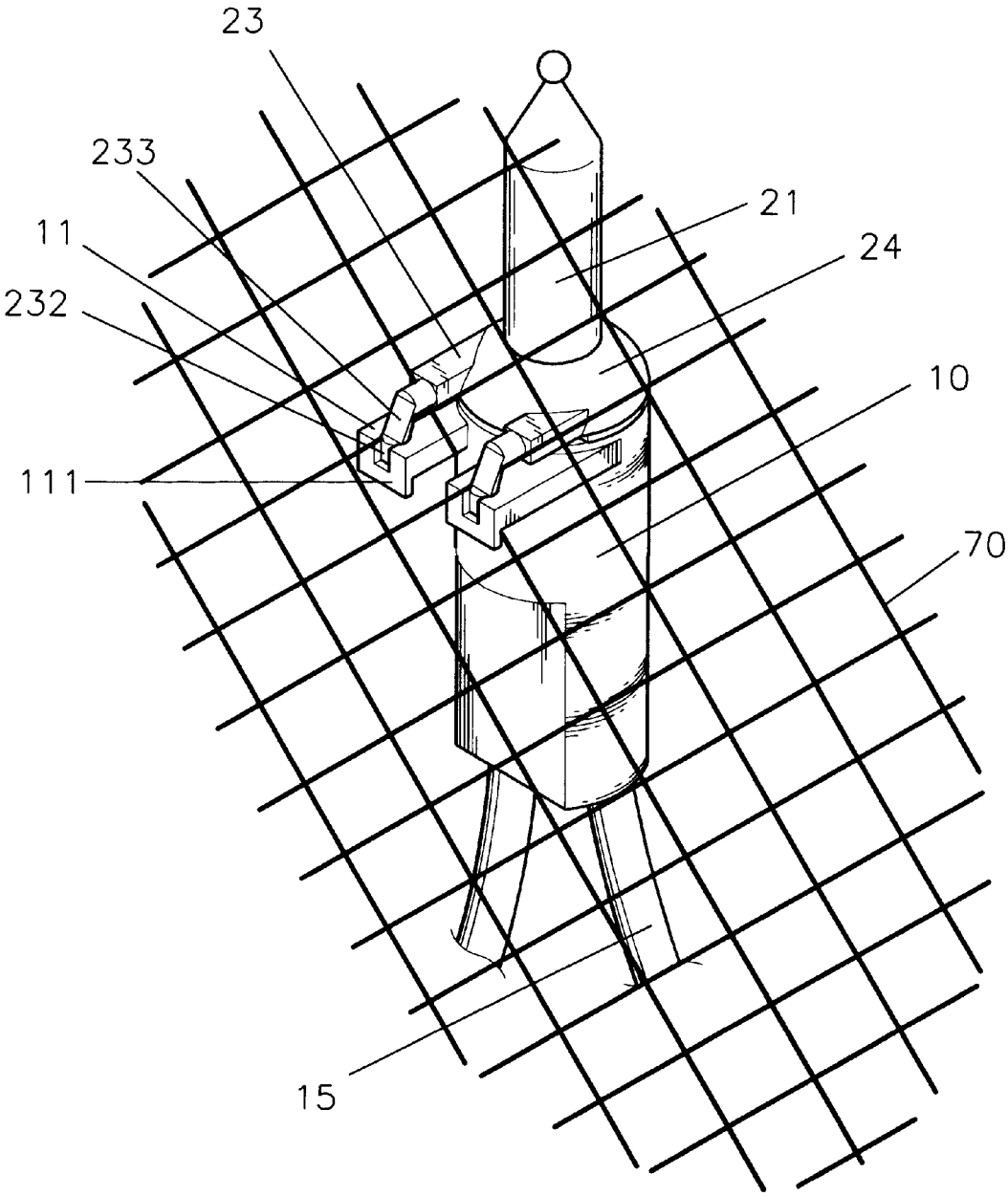
FIG. 5 is a perspective view illustating the christmas light of the present invention binding to a trellis object.
Figure 6:
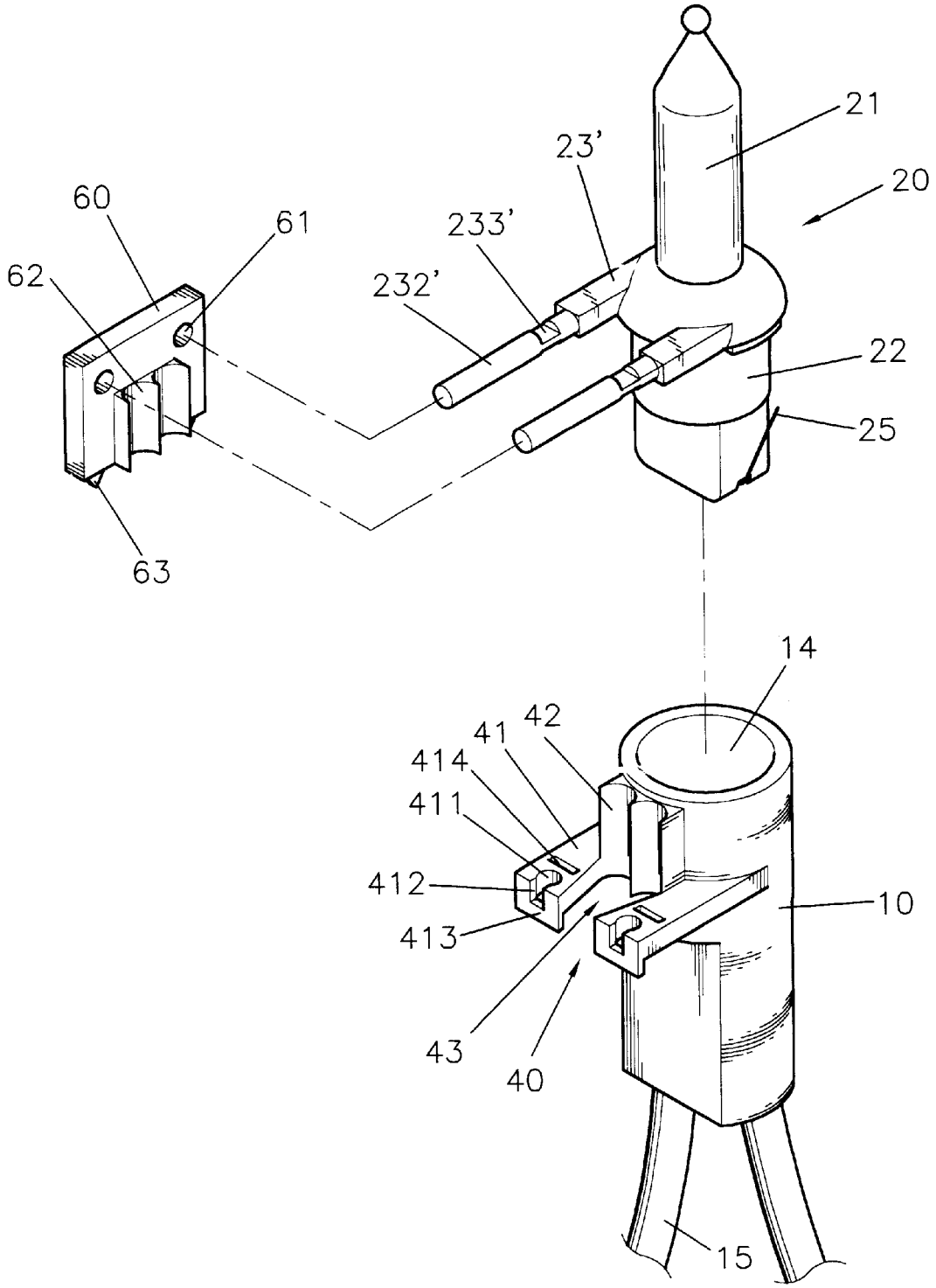
FIG. 6 is an exploded perpective to show an alternative embodiment according to present invention.

Referring to FIG. 5, in application, bend up at first the binding rods to permit linear objects such as a net, a trellis or a Christmas tree to be inserted in place between the rods 23 and arms 11 and then bend down the rods 23 again for about 90° and insert their ends 2321 into the retaining holes of the positioning arms 11. Then the light will be tightly attached to the net 70 or the Christmas tree.

Referring to FIGS. 6 to 9 of the drawings. These drawings show an alternative embodiment of the present invention in which the structure and function are mostly similar to that described in FIGS. 1 to 5 and the above discussions are are applicable in most instances. The change is that a longer flexible portion 232' of the binding rods 23' is provided instead of the flexible portion 232. On the receptacle 10, the pair of positioning arms 11 are replaced with positioning decive 40 which includes a pair of second positioning arms 41 of L-shaped section each of which has a sloped inner edge, a vertical retaining hole 411, a slot 412 in a downward portion 413 of the arm 41 abutting the hole 411 and a transverse slit 414 adjacent the hole 411. The second positioning arms 41 are positiond lower than the positioning arms 11 so as to permit a first wire clamp 42 of W-shaped section located above arms 41. The arms 41 also define a receiving space for the entrance of the wires 15.

A retaining plate 60 is provided. The plate 60 includes a pair thru holes 61 engageable with the pair of flexible portions 232' of the binding rods 23, a second wire clamp 62 of W-shaped section engageable with the first wire clamp 42 and a pair of triangular projections 63 spacedly extended downward from a lower edge and insertible into the pair of tranverse slits 414.

When the lamp 20 is disposed into the receplacle 10 and their contact wire 25 and plates are deemedly engaged in the bottom of the receptacle 10, the binding rods 23 should be in alignment with the positioning arms 41. Normally, the retaining plate 60 is attached to the positioning device 40 and locked there by bending down the flexible positions 232' of the binding rods 23.

Figure 7:
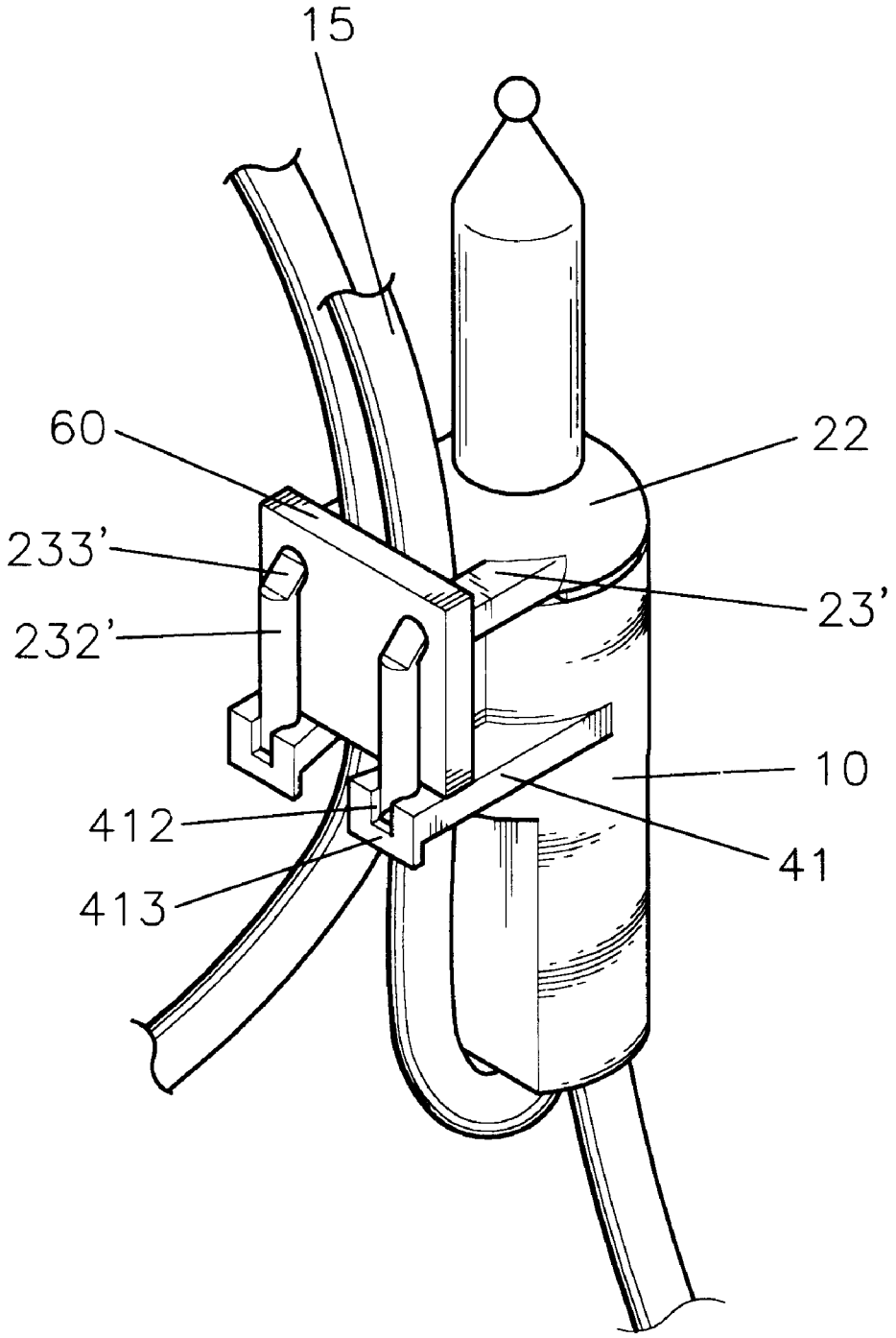
FIG. 7 is a perspective view illustrating that the electrical wires are bound by the binding device.
Figure 8:
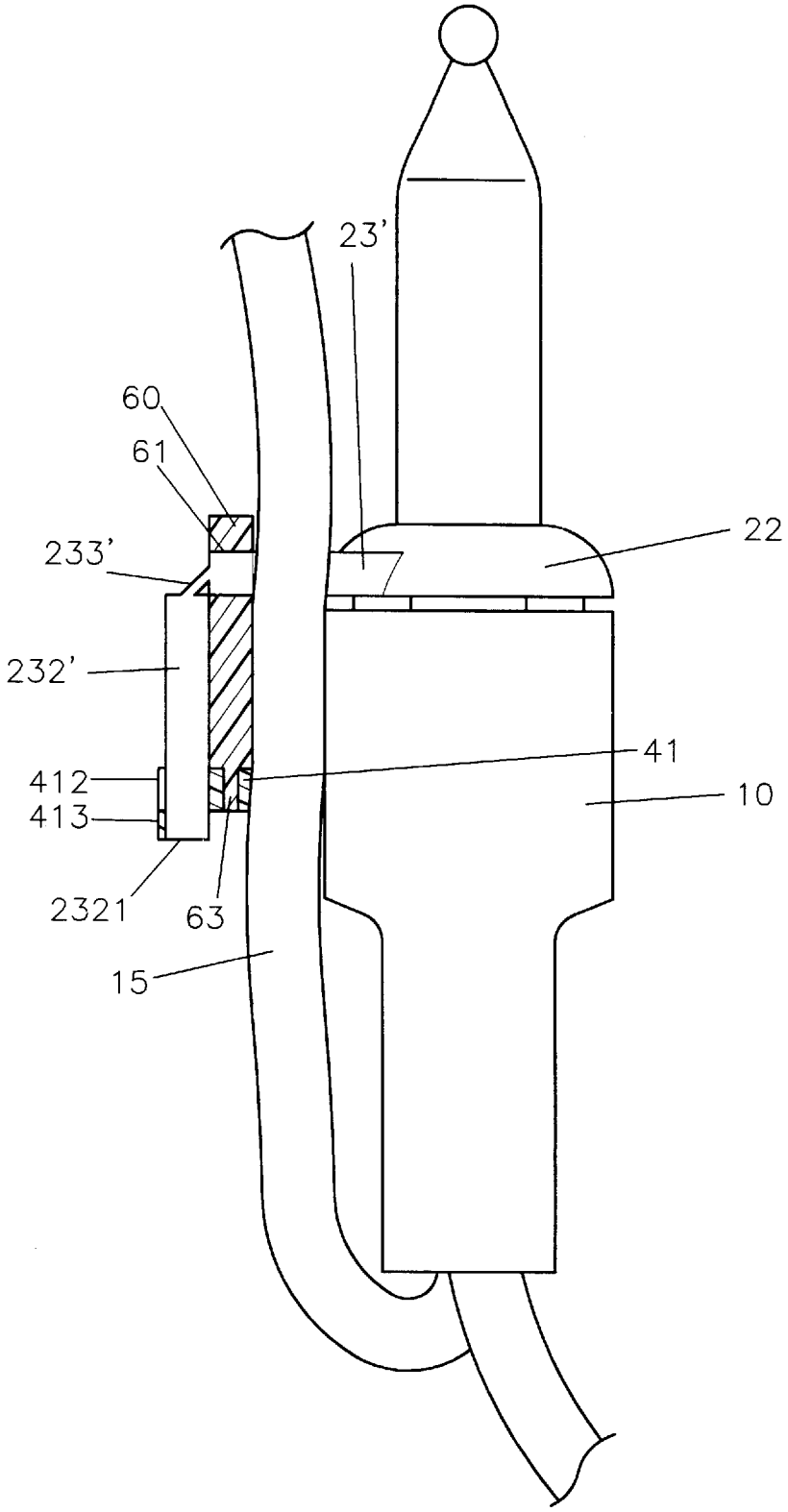
FIG. 8 is side elevational view of FIG. 7.
Figure 9:
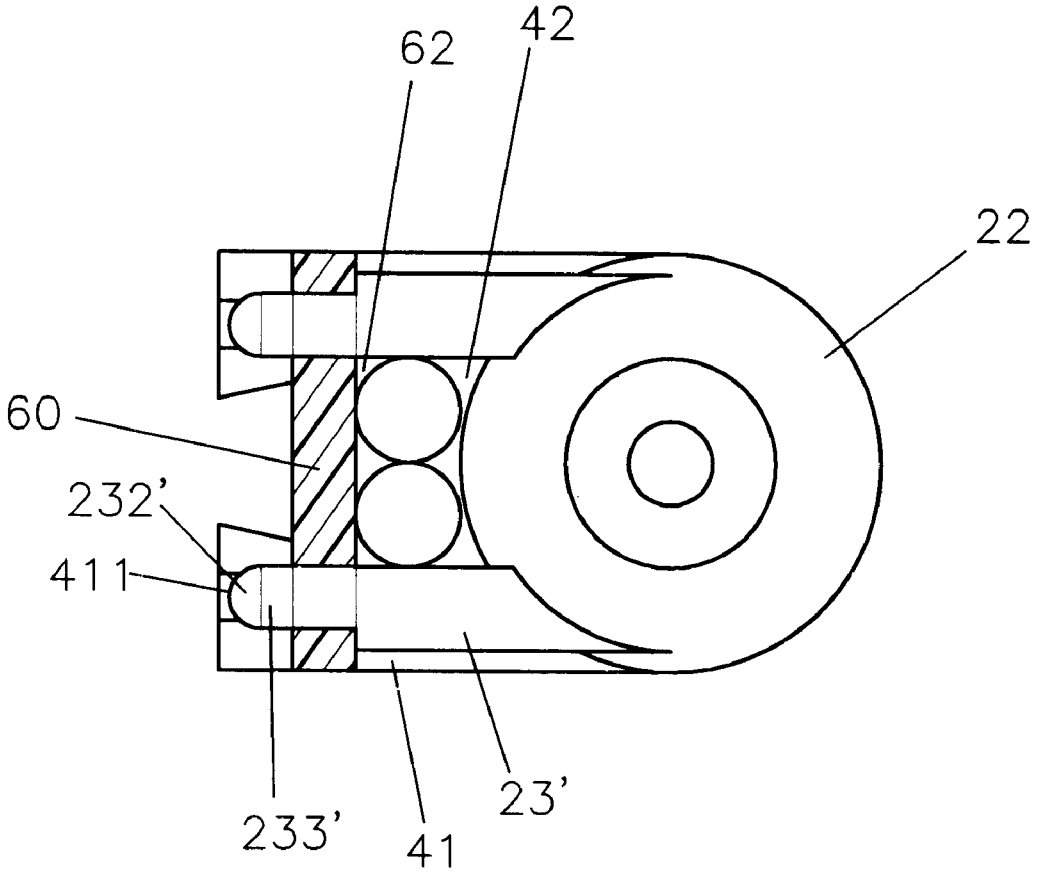
FIG. 9 is a top view of FIG. 7.
Figure 10:
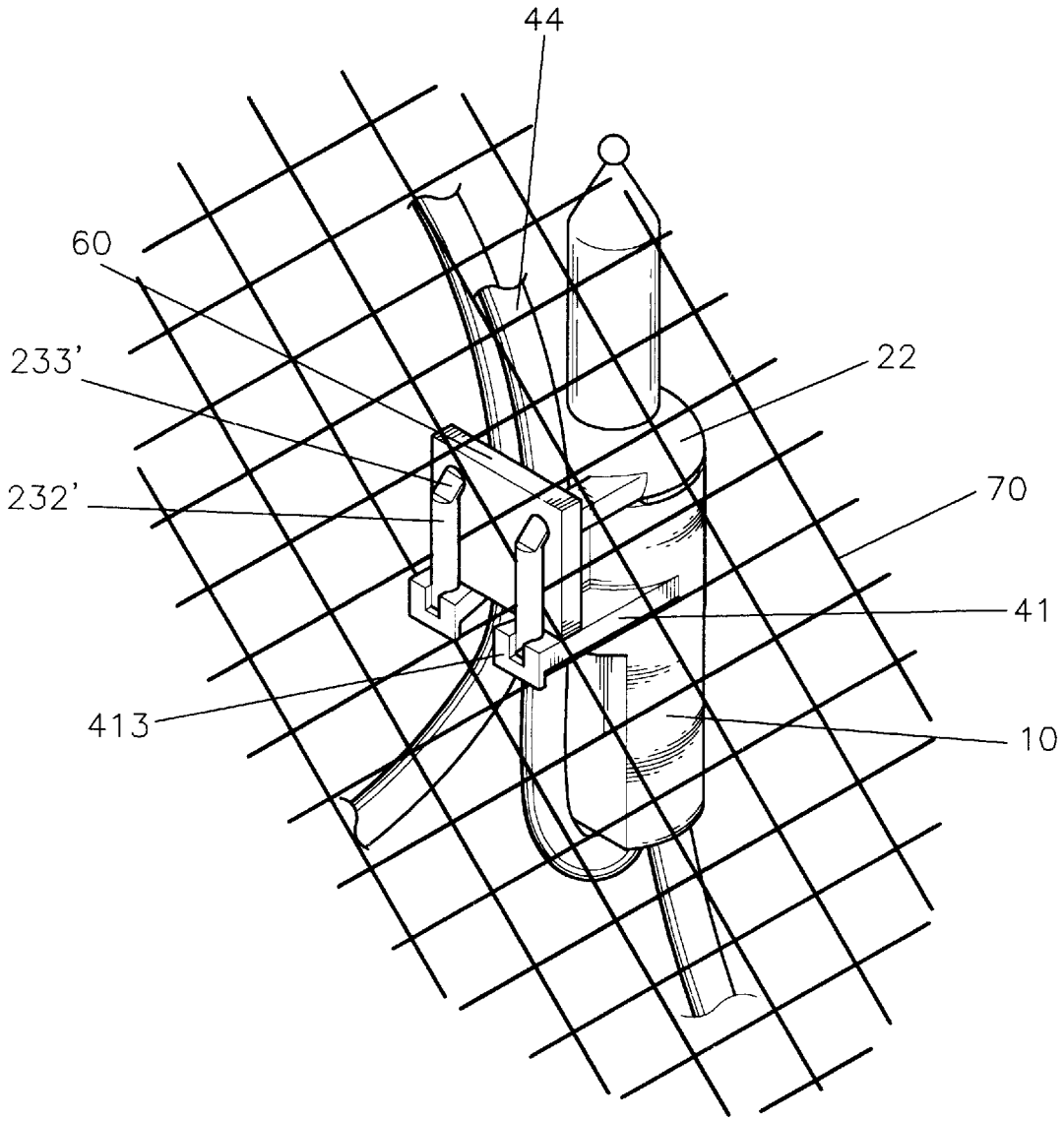
FIG. 10 is a perspective view illustrating that the light of the alternative embodiment is bound to a trellis object together with electrical wires therebetween.

In application, first bend up the binding rods to remove the retaining plate 60 so as to permit the entrance of a pair of electrical wires 15 into the reciving space 43 and disposed into the first wire clamp 42, then move in the retaining plate 60 by inserting the binding rods 23 into the thru holes 61 and inserting the pair of triangular projections 63 into the pair of transverse slits 411 so that the second wire clamp 62 is automatically coupled with the first wire clamp 42, and then bend down the binding rods to have their front end engaged into the retaining hole 411. The electrical wire 15 are therefore fixed up (as shown in FIGS. 7 to 9).

If the christmas light of the present invention attaches to a linear object of a net, a trellis or a christmas tree, bend the binding rods 23 up to allow the entrance of the object into the space between the binding rod and then bend down the rods 23 to engage the front ends within the hole 411 again. Then both the electrical wires 15 and the linear object will be retained within the christmas light which will also be stably attached to the linear object 70.

Note that the specification relating to the above embodinents should be construed as exemplary rather than as limitative of the present invention with many variations and modifications being readily attainable by a person of average skill in the art without departing from the spirit or scope thereof as defined by the append claims and their legal equivalents.

I claim:

1. An attachable Christmas light comprising:

a receptacle including a tubular body, an upper opening, a pair of contact plates in a bottom of the receptacle respectively connected with a pair of electrical wires, a pair of positioning arms laterally extending from an outer periphery lower than said upper opening to define a receiving space therebetween and each having a rectangular body of L-shape section, a sloped inner edge, a vertical slot in a downward portion of the L-shaped section of the arm abutting the retaining hole and a transverse slit in upper surface adjacent the retaining hole, and a first wire clamp of W-shaped section projected outward from the outer periphery abutting the upper opening and between the positioning arms;

a lamp including a bulb embedded into a base which is inserted into the upper opening of the receptacle, a pair of contact plates exposed to outside a portion of the base and engage with a pair of electrical wires respectively in the bottom of the receptacle;

said base having a sloped flange on a top thereof and a pair of binding rods laterally extending from an outer peripheral wall of the flange and made in alignment with the pair of positioning arms of the receptacle and each having a rigid portion, a flexible portion connected with the end of the rigid portion and a flat portion in a top of the flexible portion;

a retaining plate including a flat rectangular body, a pair of thru holes spacedly formed adjacent upper edge of the body made engageable with binding rods of said lamp, a second wire clamp of W-shaped section centrally projected outward from an inner surface of the body abutting lower edge thereof and engageable with the first wire clamp of the receptacle and a pair of triangular projections spacedly extending downward from the lower edge thereof insertible into the transverse slits of said positioning arms;

when the pair of electrical wires are disposed in place into the first wire clamp, the retaining plate is sleeved on the binding rods and its triangular projections inserted into the transverse slits to firmly clamp the electrical wires within the first and second wire clamps, after that the binding rods are bent downward about 90° and their free ends being retained in the vertical retaining holes of the positioning arms before a linear object being tangled thereinbetween.

* * * * *